US010734726B2

(12) United States Patent
Fujimoto

(10) Patent No.: US 10,734,726 B2
(45) Date of Patent: Aug. 4, 2020

(54) WIDEBAND PLANAR CIRCULARLY POLARIZED ANTENNA AND ANTENNA DEVICE

(71) Applicants: Nagasaki University, Nagasaki (JP); GIT Japan Incorporated, Shiga (JP)

(72) Inventor: Takafumi Fujimoto, Nagasaki (JP)

(73) Assignee: Nagasaki University, Nagasaki (JP)

( * ) Notice: Subject to any disclaimer, the term of this patent is extended or adjusted under 35 U.S.C. 154(b) by 379 days.

(21) Appl. No.: 15/526,285

(22) PCT Filed: Nov. 12, 2015

(86) PCT No.: PCT/JP2015/081845
§ 371 (c)(1),
(2) Date: May 11, 2017

(87) PCT Pub. No.: WO2016/076389
PCT Pub. Date: May 19, 2016

(65) Prior Publication Data

US 2018/0054001 A1 Feb. 22, 2018

(30) Foreign Application Priority Data

Nov. 12, 2014 (JP) ..... 2014-229883

(51) Int. Cl.
*H01Q 9/04* (2006.01)
*H01Q 9/40* (2006.01)
*H01Q 9/06* (2006.01)

(52) U.S. Cl.
CPC ..... *H01Q 9/0428* (2013.01); *H01Q 9/0407* (2013.01); *H01Q 9/06* (2013.01); *H01Q 9/40* (2013.01)

(58) Field of Classification Search
CPC ..... H01Q 9/0428; H01Q 9/06; H01Q 9/40; H01Q 19/19; H01Q 1/125; H01Q 3/18; H01Q 9/0407
(Continued)

(56) References Cited

U.S. PATENT DOCUMENTS

2003/0063031 A1 4/2003 Wong et al.
2007/0120741 A1* 5/2007 Tseng ..... H01Q 9/40 343/700 MS
2009/0009400 A1* 1/2009 Kim ..... H01Q 1/521 343/700 MS

FOREIGN PATENT DOCUMENTS

JP H06-077726 * 3/1994 ..... H01Q 1/08
JP 2000-082914 3/2000
(Continued)

OTHER PUBLICATIONS

Moon-Shaped Printed Monopole Antenna for Wideband Circularly Polarized Radiation, 2013 (Year: 2013).*
(Continued)

*Primary Examiner* — Ricardo I Magallanes
(74) *Attorney, Agent, or Firm* — Chernoff, Vilhauer, McClung & Stenzel, LLP

(57) ABSTRACT

A planar antenna includes a patch conductor formed on a front surface of a dielectric substrate 20 so to be obliquely arranged in relation to an orthogonal axis of the dielectric substrate, the patch conductor having an elliptic shape; a microstrip line 40 for feeding power to a bottom part of the patch conductor; and a ground conductor plate 50 formed on a back surface of the dielectric substrate at a position thereof that is not overlapped with the patch conductor. By forming the patch conductor to be inclined only by θ, circular polarization characteristics in which axial ratio is 3 dB or less are given and the wideband such that the frequency bandwidth in which VSWR characteristics are 2 or less is 2
(Continued)

10: WIDEBAND PLANAR CIRCULARLY POLARIZED ANTENNA through 5 GHz and the wideband in UWB High band can be attained. The antenna characteristics in which any radiation directivity on the zenith direction does not depend on the frequency are obtained.

3 Claims, 9 Drawing Sheets

(58) Field of Classification Search
USPC ..... 343/839, 880, 915
See application file for complete search history.

(56) References Cited

FOREIGN PATENT DOCUMENTS

| | | | | |
|---|---|---|---|---|
| JP | 2002-026634 | | 1/2002 | |
| JP | 2005-236656 | | 9/2005 | |
| WO | WO1998/050977 | A1 | 11/1998 | |
| WO | WO-2018073522 | A1 * | 4/2018 | ..... H01Q 21/28 |

OTHER PUBLICATIONS

Design of Ultrawideband Planar Monopole Antennas of Circular and Elliptical Shape, 2008 (Year: 2008).*
Hiroki (JPH06-077726), English translation (Year: 1994).*
Fujimoto etal. (IET Microw. Antennas Propag., 2014, vol. 8, Iss.9) (Year: 2014).*
Hu et al. (Moon-Shaped Printed Monopole Antenna for Wideband Circularly Polarized Radiation, 2013) (Year: 2013).*
Japanese Patent Office, International Search Report, dated Feb. 2, 2016, 5 pgs.
Japanese Patent Office, Written Opinion, dated Feb. 2, 2016, 5 pgs.
IET Microwaves, Antennas & Propagation, pp. 1-8 doi: 10.1042/iet-map.2013.0460.
ITE Technical Report, vol. 38, No. 5, BCT 2014-2 (Jan. 2014).
IET Microwaves, Antennas & Propagation, 2014, vol. 8, Iss. 4, pp. 263-271, doi: 10.1049/iet-map.2013.0249.
IEEE Transactions on Antennas and Propagation, vol. 55, No. 4, Apr. 2007.

* cited by examiner $\omega t = 190°$ $\omega t = 280°$

AXIAL RATIO CHARACTERISTICS WHEN CHANGING GRADIENT θ OF PATCH CONDUCTOR (AXIAL RATIO ≦3dB IN RANGE OF θ=40° – 80°)

|S11| CHARACTERISTICS WHEN CHANGING GRADIENT θ OF PATCH CONDUCTOR(|S11| ≦ −10dB IN RATION OF θ=40° − 80°)

WIDEBAND PLANAR CIRCULARLY POLARIZED ANTENNA AND ANTENNA DEVICE

TECHNICAL FIELD

The present invention relates to a wideband planar circularly polarized antenna and an antenna device. For more information, it particularly relates to a wideband planar circularly polarized antenna of printed board type and an antenna device, which are capable of being used in WiFi (Wireless Fidelity, brand name) in the band of 2.0 GHz to 5.0 GHz, WiMAX (Worldwide Interoperability for Microwave access), UWB (Ultra Wide Band) wireless communication in the band of 3.1 GHz to 10.6 GHz and the like.

BACKGROUND

Circular polarization has been used for GPS radio wave, satellite radio wave for satellite digital broadcasting and radio wave for ETC and various kinds of circularly polarized antennas have been proposed (See Patent Document 1).

In recent years, the circular polarization has been widely utilized into wireless LAN represented by WiFi, and wireless communication such as WiMAX and UWB for use of middle-range communication, mobile communication etc. Since a thin and light-weight circularly polarized antenna installed in the wireless communication equipment is required, a planar antenna formed by a printed board etc. is becoming mainstream.

Several wideband planar circularly polarized antennas corresponding thereto have been proposed. For example, non-patent document 1 which the inventors have proposed describes a rectangular antenna element that is obliquely arranged. Non-patent document 2 describes a rectangular antenna element in which a sub pattern of nested structure is formed. Non-patent document 3 describes an antenna element of rectangular loop pattern.

An elliptical antenna element has been known as the wideband planar linearly polarized antenna (see non-patent document 4).

DOCUMENTS FOR PRIOR ART

Patent Document

Patent Document 1: Japanese Patent Application Publication No. 2005-236656

Non-Patent Documents

Non-patent document 1: IET Microw. Antennas Propag., pp 1-8 doi:10.1049/iet-map.2013.0460

Non-patent document 2: ITE Technical Report Vol. 38, No. 5 BCT2014-2 (January 2014)

Non-patent document 3: IET Microw. Antennas Propag., 2014, Vol. 8, 1ss. 4, pp 263-271 doi:10.1049/iet-map.2013.0249

Non-patent document 4: IEEE TRANSACTIONS ON ANTENNAS AND PROPAGATION, VOL. 55. NO. 4, APRIL. 2007

SUMMARY OF THE INVENTION

Problems to be Solved by the Invention

The above-mentioned wideband planar circularly polarized antennas and antenna devices have some problems as follows.

The non-patent document 1 discloses a rectangular monopole antenna of printed board type, which is a simple rectangular antennal element and has an advantage such that antenna characteristics are hardly affected by manufacturing errors in the mass production. It has achieved a frequency band of 1.75 GHz to 4.22 GHz as a frequency bandwidth (1.73 GHz to 4.27 GHz as a frequency bandwidth satisfying return loss of 10 dB or less and axial ratio (AR) of 3 dB or less) but that bandwidth is no yet satisfied.

In the non-patent documents 2 and 3, a frequency bandwidth is wide but shapes of their antenna elements are complicated because the sub pattern or the rectangular loop is required to be formed. Therefore, they are easily affected by manufacturing errors in the mass production, and particularly, this causes a problem such that axial ratio characteristic, which represents circular polarization characteristics, is instable.

In addition, as shown in the non-patent document 4, the elliptical antenna element in a monopole antenna configuration is known for the wideband planar linearly polarized antenna. In such a case, an electric field having a vector direction to a major axis of the elliptical patch occurs as radiation from the elliptical patch and an electric field having a direction to the major axis of the elliptical patch also occurs from the ground conductor part because electric current passes through the ground conductor part symmetrically in relation to the major axis of the elliptical patch or a microstrip line. Therefore, it can radiate only the linearly polarized wave of which electrical field has a direction to the major axis of the elliptical patch. It cannot radiate any circular polarization, therefore cannot be used for any circularly polarized antenna of UHF band or SHF band.

The present invention solves such past problems and has an object to provide a wideband planar circularly polarized antenna and antenna device, each of which has a simply shaped antenna element and acquires a wide frequency bandwidth.

Means for Solving the Problems

In order to solve the above-mentioned problems, a wideband planar circularly polarized antenna according to the invention includes a patch conductor formed on a front surface of a dielectric substrate the patch conductor having a smooth contour and a shape having a major axis; a microstrip continuously connected to a bottom part of the patch conductor, the microstrip line having a linear center axis; and a ground conductor plate formed on a back surface of the dielectric substrate of a bottom side of the patch conductor, wherein the patch conductor is inclined so that its major axis has a predetermined angle $\theta$ in relation to an orthogonal direction of the center axis of the microstrip line; and wherein the ground conductor plate has an approximately rectangular outer shape and has a cut portion in a contour thereof, the cut portion being along the contour of the bottom part of the patch conductor with a gap, and a diagonal line of the ground conductor plate opposed to an inclination of the major axis of the patch conductor being crossed with the major axis of the patch conductor almost at a right angle.

The wideband planar circularly polarized antenna is characterized in that a total of lengths of the microstrip line and the major axis of the patch conductor is configured to be almost equal to a length of the diagonal line of the ground conductor plate.

The wideband planar circularly polarized antenna is characterized in that the patch conductor is inclined by a predetermined gradient θ such that the phase between the electric field radiated from the patch conductor and the electric field radiated from the ground conductor plate is about 90 degrees and a direction of the major axis of the patch conductor is almost orthogonal to the diagonal line of the ground conductor plate.

The wideband planar circularly polarized antenna is characterized in that the gradient θ of the patch conductor is selected to be within a range of 40 degrees≤θ≤80 degrees.

The wideband planar circularly polarized antenna is characterized in that the gradient θ of the patch conductor is selected to be within the range from 50 degrees through 60 degrees.

The wideband planar circularly polarized antenna is characterized in that the shape of the patch conductor is an elliptical shape.

An antenna device is characterized in that the device installs the wideband planar circularly polarized antenna.

Effects of the Invention

According to this invention, a wideband planar circularly polarized antenna can be realized by configuration such that the amplitude of the electric field radiated from each of the patch conductor and the ground conductor plate is the same, the patch conductor is inclined by a predetermined gradient and the phase between the electric field radiated from the patch conductor and the electric field radiated from the ground conductor plate is about 90 degrees.

Accordingly, the antenna has a very simple structure and is thin and light-weighted so that it is possible to provide the planar antenna that is superior in portability. Further, regarding circular polarization characteristics, the frequency bandwidth satisfying that VSWR (Voltage Standing Wave Ratio) is 2 or less and the axial ratio is 3 dB or less becomes 88.4%, which can realize a frequency band of 2.1 GHz to 5.5 GHz or 3.1 GHz to 10.6 GHz.

Additionally, since an even radiation directivity which doesn't depend on the frequency can be acquired in the zenith direction, this planar antenna has a feature such that it can be installed without considering the direction of the antenna.

EMBODIMENTS FOR CARRYING OUT THE INVENTION

The following will describe an embodiment of a wideband planar circularly polarized antenna according to the present invention.

Embodiment 1

The wideband planar circularly polarized antenna according to the present invention realizes wideband circularly polarization characteristics by configuration such that the amplitude of the electric field radiated from each of the patch conductor and the ground conductor plate is the same (Condition 1) and the phase between the electric field radiated from the patch conductor and the electric field radiated from the ground conductor plate is about 90 degrees (Condition 2). In this embodiment, a case where the phase between the electric field radiated from the patch conductor and the electric field radiated from the ground conductor plate is 90 degrees will be described.

The Condition 1 will be described. The patch conductor generates the electric field having a direction along the major axis and the ground conductor plate generates the electric field having a direction along the diagonal line thereof. So, if a length of the patch conductor including a microstrip line and a length of the diagonal line of the ground conductor plate are selected to be almost equal each other, the amplitude of the electric field radiated from the patch conductor and radiated from the ground conductor plate will be almost equal each other.

The Condition 2 will be described. Radio waves radiated from the patch conductor and the ground conductor plate will have a shift by ωt=90 degrees if the direction of the major axis of the patch conductor is set at about right angles to the diagonal direction of the ground conductor plate. Accordingly, these two orthogonal electric fields have a phase of 90 degrees, which generates circular polarization. In order to set the major axis direction of the patch conductor at about right angles to the diagonal direction of the ground conductor plate, the patch conductor is inclined by θ in relation to the dielectric substrate.

Figure 1:
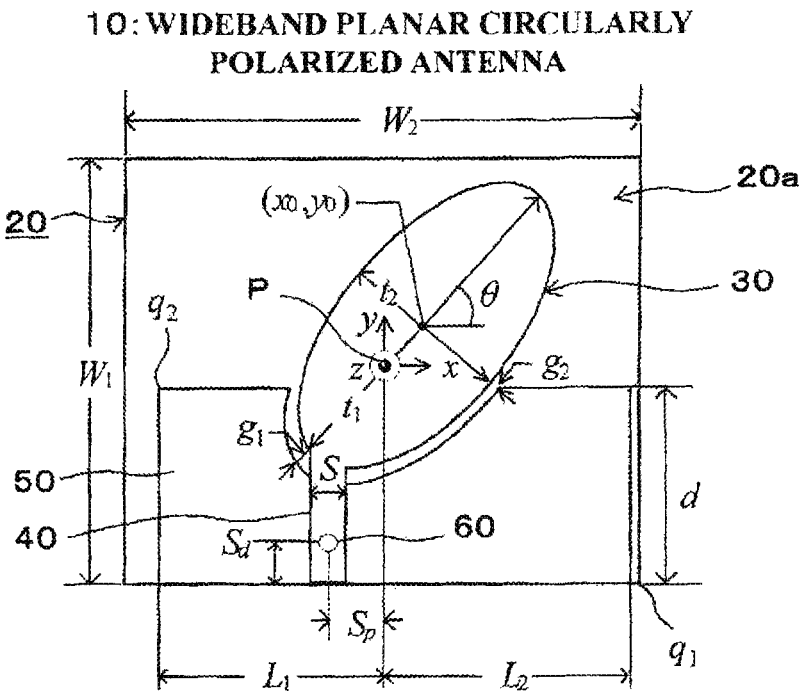
FIG. 1 is a plane view of a wideband planar circularly polarized antenna showing an example thereof according to the present invention.

FIG. 1 shows an example of the wideband planar circularly polarized antenna 10 that is configured as a monopole antenna of printed board type for circular polarization.

This planar antenna 10 is configured so as to include a rectangular dielectric substrate 20, a patch conductor 30 (as an antenna element) adhesively formed on a front surface 20*a* thereof, a microstrip line 40 connecting to this patch conductor 30, and a ground conductor plate 50 adhesively formed on a back surface 20*b* of the dielectric substrate 20.

As the dielectric substrate 20, a rectangular substrate having a length W1, a width W2 and a thickness h is used. Its relative electric permittivity is sr. In this embodiment, a printed board is used as the dielectric substrate 20.

The patch conductor 30 has a smooth contour and a shape having a longitudinal direction. In this embodiment, it has an elliptical shape determined by lengths of a major axis t1 and a minor axis t2. A microstrip line 40 having a predetermined width s is connected to the patch conductor 30 and a signal to be transmitted or received is fed through the microstrip line 40. A feeding point 60 is provided at a predetermined point of the microstrip line 40.

The patch conductor 30 is arranged around a middle portion of the dielectric substrate 20 so to be inclined by θ to an orthogonal axis of the dielectric substrate 20 (namely, it is inclined by θ on the basis of a focus (x0, y0) of the patch conductor). In this embodiment, a case of θ=50 degrees will be indicated.

It is set so that the major axis of the patch conductor 30 passes through a middle point P of the dielectric substrate 20 and the focus (x0, y0) of the patch conductor 30 is positioned slightly above the middle point P. In addition, the connecting position relation with the patch conductor 30 and the microstrip line 40 is selected so that an end edge of the microstrip line 40 is positioned at a peripheral end edge, which is shifted to left side from the middle P of the antenna, of the patch conductor 30. In other words, a position of the microstrip line 40 connected to the patch conductor 30 is shifted by Sp from the middle P of the antenna (the middle point of the dielectric substrate 20).

The microstrip line 40 is adhesively formed to extend parallel to a vertically side end edge of the dielectric substrate 20 and reach a horizontally side end edge thereof. The feeding point 60 is provided at a position that is away from the horizontally side end edge by Sd (and the position that is away from the middle point P of the dielectric substrate 20 by Sp).

The ground conductor plate 50 is adhesively formed at a certain position on the back surface 20*b* of the dielectric substrate 20 not to overlap with the patch conductor 30 adhesively formed on the front surface 20*a*, and to cover a smaller area than the dielectric substrate.

Specifically, the ground conductor plate 50 is approximately rectangular and formed to have an area (d*(L1+L2)) to cover a half or less of the dielectric substrate 20. In this embodiment, an upper periphery of the ground conductor plate 50 corresponding to a lower peripheral portion of the patch conductor 30 is shaped (almost U-shape) to extend around the lower peripheral portion, but not to overlap the lower peripheral portion of the patch conductor 30. As a result thereof, an upper periphery of the ground conductor plate has a curved shape leaving predetermined gaps g1, g2 between the lower peripheral portion of the patch conductor 30 and the ground conductor plate 50, as seen in FIG. 1. These gaps g1, g2 are selected so that they are slightly different from each other (g1>g2).

Figure 2:
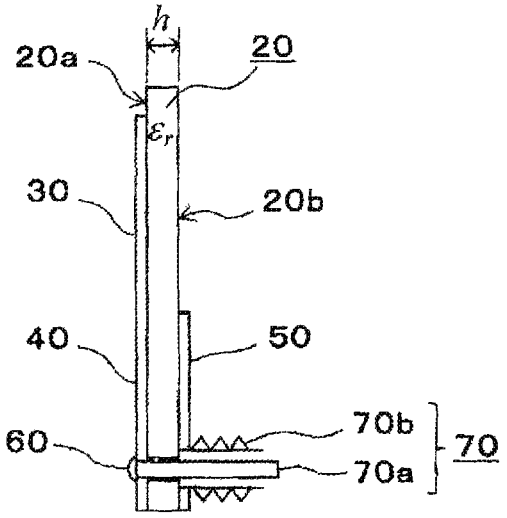
FIG. 2 is a side view thereof.

Electric supply to the microstrip line 40 is fed from the back surface 20*b* of the dielectric substrate 20. Accordingly, as shown in FIG. 2, a through-hole for the feeding point is provided at the dielectric substrate 20 on which the microstrip line 40 is formed, and a feeder 70 is attached from the back surface side. As the feeder 70, a coaxial cable is used. A core 70*a* (inner conductor) extends through the through-hole and is connected to the microstrip line 40 and a ground wire 70*b* (outer conductor: braided wire) is connected to the ground conductor plate 50.

The ground conductor plate 50 has a nearly rectangular shape and a length of the diagonal line joining vertexes q1, q2 is fixed by a long side (L1+L2) and a short side d, which are selected so that the length of the diagonal line is almost equal to the above-described total of lengths of the microstrip line 40 and the major axis of the patch conductor 30.

Thus, the patch conductor 30 is inclined by θ; the position of the microstrip line is shifted from the middle P of the antenna by Sp; the focus position (x0, y0) of the patch conductor 30 is shifted upward from the middle P of the antenna; a size of the ground conductor plate 50 is selected so that the major axis t1 of the patch conductor 30 is almost at right angle to the diagonal line of the ground conductor plate 50; and the length of the patch conductor 30 including the microstrip line 40 is set to be around the above-mentioned length of the diagonal line.

It is to be noted that an angle between the major axis t1 and the diagonal line of the ground conductor plate 50 is not a right angle in FIG. 1 because of drawing restriction.

By thus setting each size etc. of the planar antenna 10, the (condition 1) that the amplitude of the electric field radiated from each of the patch conductor 30 and the ground conductor plate 50 is the same, and the (condition 2) that the phase between the electric field radiated from the patch conductor and the electric field radiated from the ground conductor plate is 90 degrees, are both satisfied.

The following will describe an example of specifications (parameters) of the wideband planar circularly polarized antenna 10 thus configured.

Example of Specifications

Vertical length W1 of the dielectric substrate 20 is 50 mm.

Horizontal length W2 of the dielectric substrate 20 is 60 mm.

Thickness h of the dielectric substrate 20 is 1.6 mm.

Relative electric permittivity a of the dielectric substrate 20 is 2.6.

Major axis t1 of the patch conductor 30 is 20 mm.

Minor axis t2 of the patch conductor 30 is 10 mm.

Gradient θ of the patch conductor 30 is 50 degrees.

Width S of the microstrip line 40 is 4 mm.

Length L1 of the ground conductor plate 50 is 30 mm.

Length L2 of the ground conductor plate 50 is 30 mm.

Length d of the ground conductor plate 50 is 23 mm.

Gap g1 is 0.6 mm.

Gap g2 is 0.4 mm.

Distance Sd up to the feeding point 60 is 3 mm.

Shift Sp between the feeding point 60 and the middle point P is 7.5 mm.

The following will describe various kinds of characteristics of the wideband planar circularly polarized antenna 10 according to the invention.

FIGS. 3A through 3D show electric current distribution states in an operation of the wideband planar circularly polarized antenna 10 according to the invention, in which the used frequency is 2.3 GHz. The following will describe a consideration using representative phase angles cot shifted by 90 degrees each other on the base of initial phase angle wt, which is ωt=10 degrees but not ωt=0 degrees in this embodiment.

Figure 3A:
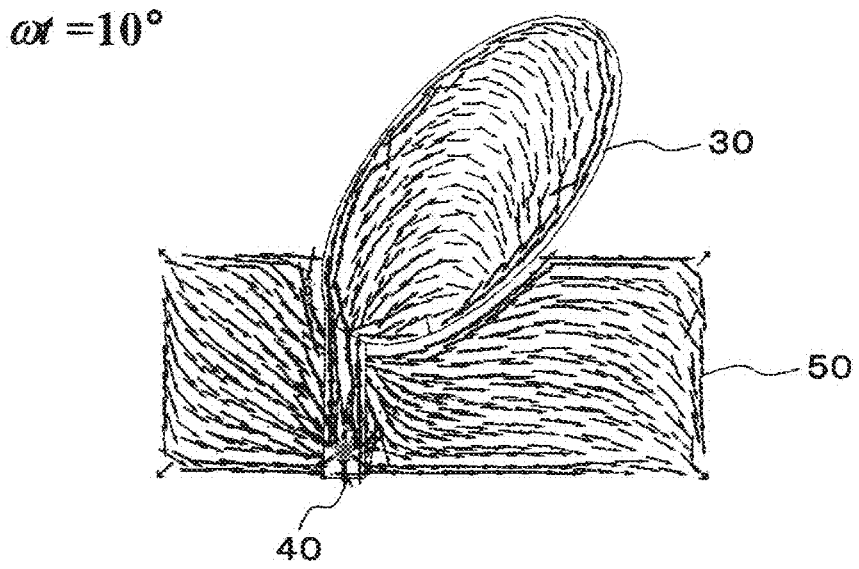
FIG. 3A is a diagram showing an electric current distribution state in the planar antenna according to the invention (in a case of ωt=10 degrees).

FIG. 3A shows a distribution of the electric currents passing through the patch conductor 30 and the ground conductor plate 50 in a case of ωt=10 degrees. As clearly seen from that figure, the direction of the electric currents passing through the patch conductor 30 on a left side peripheral portion is opposite to that on a right side peripheral portion, so the electric currents flow oppositely each other at either side of the microstrip line 40. Therefore, it is comprehended that the electric currents passing through the patch conductor 30 are countervailed and do not contribute to any radiation.

On the other hand, on the ground conductor plate 50, the electric currents flow only in a direction from an upper left to a lower right, therefore it is comprehended that the electric currents passing through the ground conductor plate 50 contribute to the radiation at the phase angle of ωt=10 degrees.

Figure 3B:
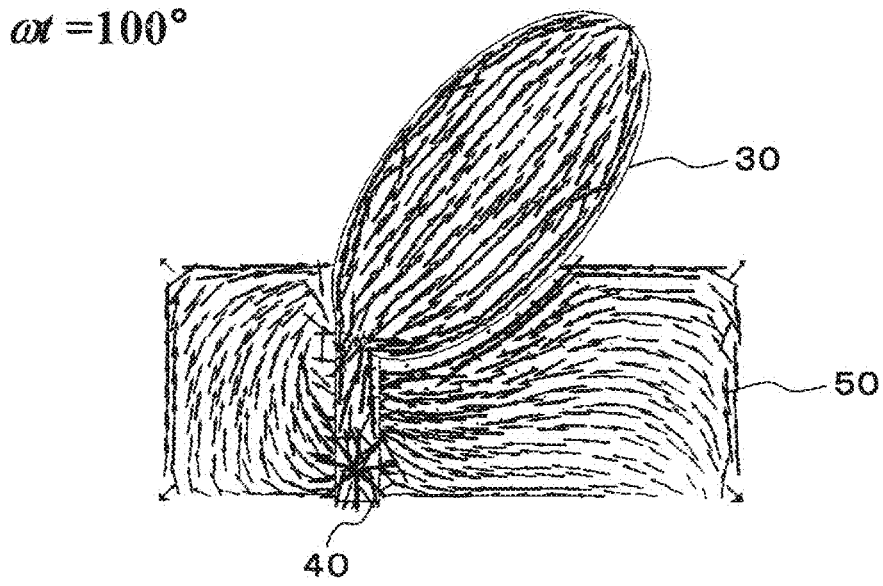
FIG. 3B is a diagram showing the electric current distribution state in the planar antenna according to the invention (in a case of ωt=100 degrees).

FIG. 3B shows a distribution of the electric currents passing through the patch conductor 30 and the ground conductor plate 50 in a case of ωt=100 degrees. As clearly seen from that figure, on the ground conductor plate 50, the electric currents flow oppositely each other on either side of the microstrip line 40. Therefore, the electric currents passing through the ground conductor plate 50 do not contribute to any radiation.

On the other hand, on the patch conductor 30, the electric currents flow in a direction from a lower left to an upper right from the microstrip line 40 on a left side peripheral portion and a right side peripheral portion. Therefore, the electric currents passing through the patch conductor 30 contribute to the radiation at the phase angle of ωt=100 degrees.

Figure 3C:
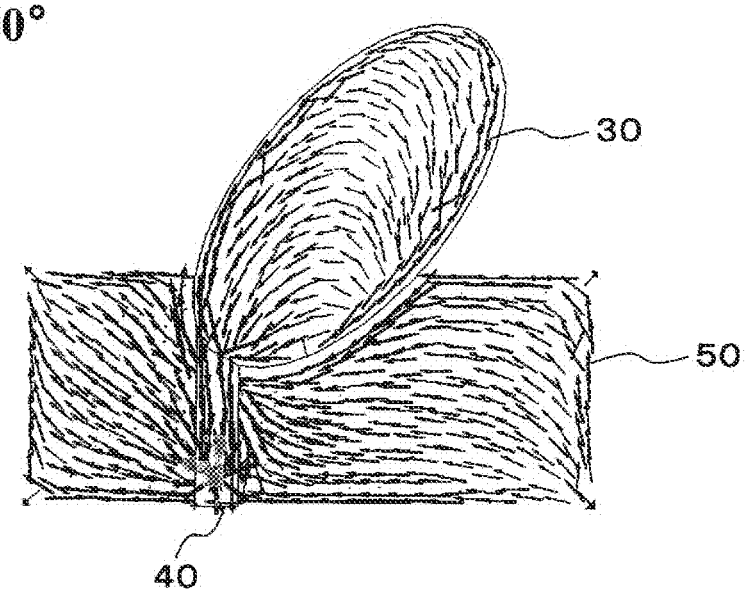
FIG. 3C is a diagram showing the electric current distribution state in the planar antenna according to the invention (in a case of ωt=190 degrees).

FIG. 3C shows a distribution of the electric currents passing through the patch conductor 30 and the ground conductor plate 50 in a case of ωt=190 degrees. As clearly seen from that figure, the electric currents passing through the patch conductor 30 on a left side peripheral portion flow oppositely to that on a right side peripheral portion at either side of the microstrip line 40 (which is similar to a case shown in FIG. 3A). Therefore, the electric currents passing through the patch conductor 30 do not contribute to any radiation.

On the other hand, on the ground conductor plate 50, the electric currents flow only in a direction from a lower right to an upper left, therefore it is comprehended that the electric currents passing through the ground conductor plate 50 contribute to the radiation at the phase angle of ωt=190 degrees.

Figure 3D:
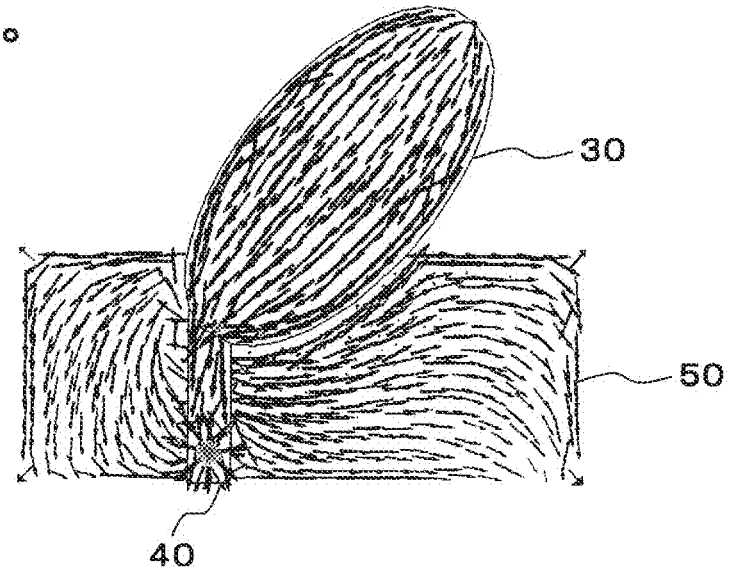
FIG. 3D is a diagram showing the electric current distribution state in the planar antenna according to the invention (in a case of ωt=280 degrees).

FIG. 3D shows a distribution of the electric currents passing through the patch conductor 30 and the ground conductor plate 50 in a case of ωt=280 degrees. As clearly seen from that figure, on the ground conductor plate 50, the electric currents flow oppositely each other on either side of the microstrip line 40. Therefore, the electric currents passing through the ground conductor plate 50 do not contribute to any radiation.

On the other hand, on the patch conductor 30, the electric currents flow in a direction from an upper right to a lower left to the microstrip line 40 on a left side peripheral portion and a right side peripheral portion. Therefore, it is comprehended that the electric currents passing through the patch conductor 30 contribute to the radiation at the phase angle of ωt=280 degrees.

As being clear from the flowing directions of electric currents shown in FIGS. 3A through 3D, the direction of the electric currents in each phase angle turns clockwise so that it is comprehended that the electric current distribution turns from ωt=0 degrees, which is a starting point, to 270 degrees through 90 degrees and 180 degrees (which turns around to the right in this embodiment). As a result thereof, it is comprehended that the wideband planar antenna according to the invention functions as a planar circularly polarized antenna.

Figure 4:
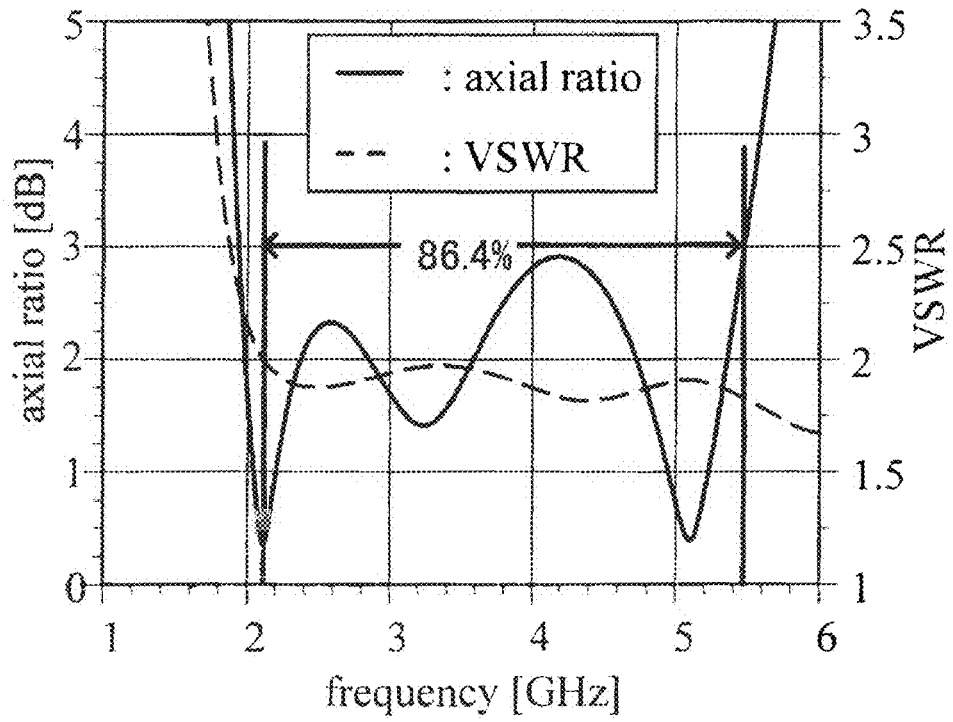
FIG. 4 is a characteristics graph showing axial ratio and VSWR characteristics.

FIG. 4 shows a frequency bandwidth in antenna characteristics of the wideband planar circularly polarized antenna 10 according to the invention. In the circularly polarized antenna, a band that shows axial ratio characteristic of 3 dB or less and VSWR characteristic of 2 or less is an operational frequency bandwidth of the said antenna.

Here, the axial ratio is represented by a ratio of a major axis and a minor axis of elliptically polarized wave. When the axial ratio is 3 dB or less, it is regarded as indicating the circular polarization characteristics. Further, the VSWR (Voltage Standing Wave Ratio) means a reflection coefficient of input voltage at the antenna feeding point 60. VSWR=2 corresponds to −10 dB of S parameter (characteristic parameter).

In FIG. 4, the solid curve indicates a simulated value of the axial ratio characteristic and the dotted curve indicates a simulated value of the VSWR values. The lower limit value f1 of the frequency which satisfies both of the axial ratio of 3 dB or less and the VSWR value of 2 or less is about 2.12 GHz and the upper limit value f2 thereof is 5.48 GHz, so that the frequency bandwidth of this planar antenna 10 is 88.4%. This frequency bandwidth covers a part of the UHF band and a part of the SHF band.

Figure 5:
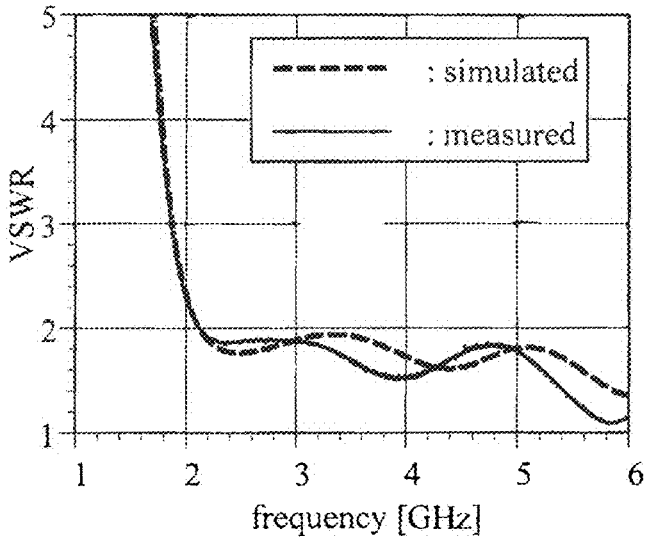
FIG. 5 is a characteristics graph showing a relationship between simulated values and measured values of the VSWR characteristics.
Figure 6:
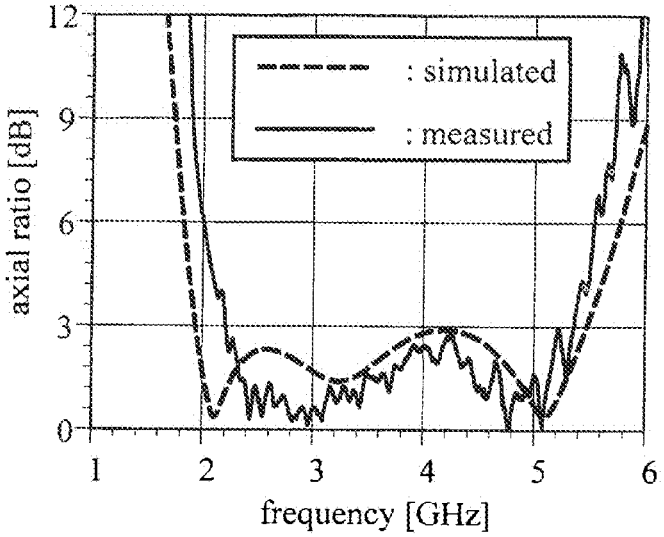
FIG. 6 is a characteristics graph showing a relationship between simulated values and measured values of the axial ratio characteristics.

FIGS. 5 and 6 show the relationships between the above-mentioned simulated values and actual (measured) values. In FIG. 5, the dotted curve indicates the simulated value of the VSWR and the solid curve indicates a measured value thereof. It is clear that both are closely approximate to each other.

Similarly, in FIG. 6, the dotted curve indicates the simulated value of the axial ratio and the solid curve indicates a measured value thereof. According to the shown actual values, f1 is 2.21 GHz and f2 is 5.36 GHz so that the operational frequency bandwidth is 83.2% while the former is 88.4% as described above. Therefore, it is clear that quality which is nearly equal to the simulated values is obtained.

Thus, according to the antenna characteristics shown in FIGS. 4 through 6, it is comprehended that the planar antenna 10 according to the invention covers very broad operational frequency bandwidth.

Figure 7:
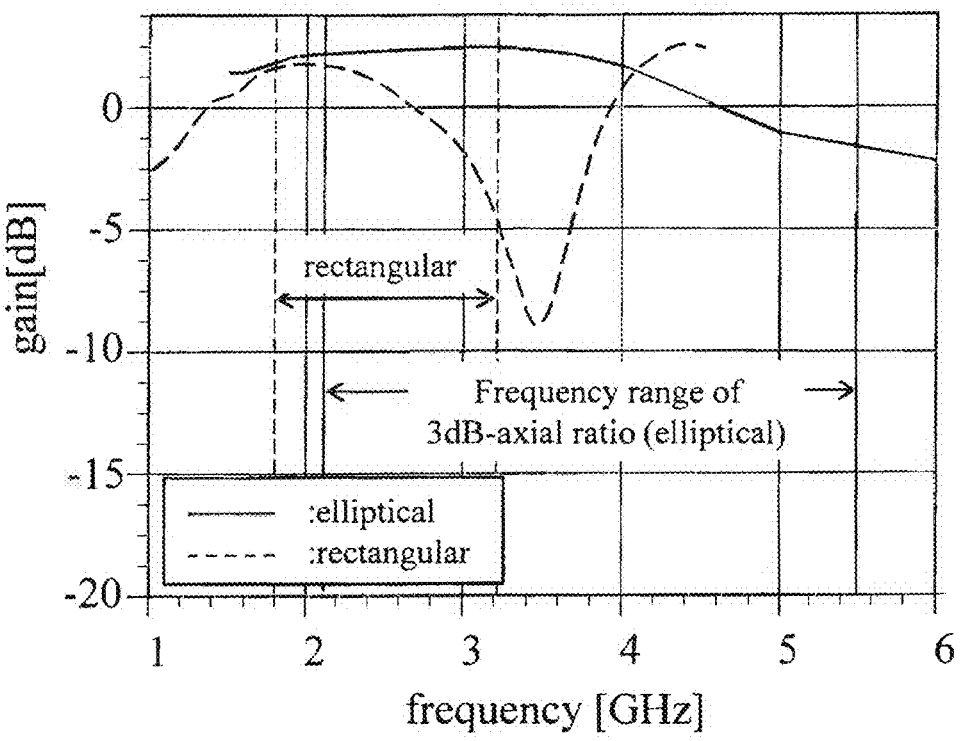
FIG. 7 is a characteristics graph showing a gain in the zenith direction.

FIG. 7 shows an operational frequency bandwidth in antenna characteristics (radiation gain characteristic) in the zenith direction. The solid characteristic curve indicates a radiation gain characteristic of this invention and the dotted characteristic curve indicates an operational frequency bandwidth of the rectangular monopole antenna disclosed in the non-patent document 1.

As clearly seen from that figure, the operational frequency bandwidth in the zenith direction of the planar antenna according to the invention is several times broader than the operational frequency bandwidth disclosed in the non-patent document 1, and an even radiation gain characteristic is also obtained therein.

Figure 14:
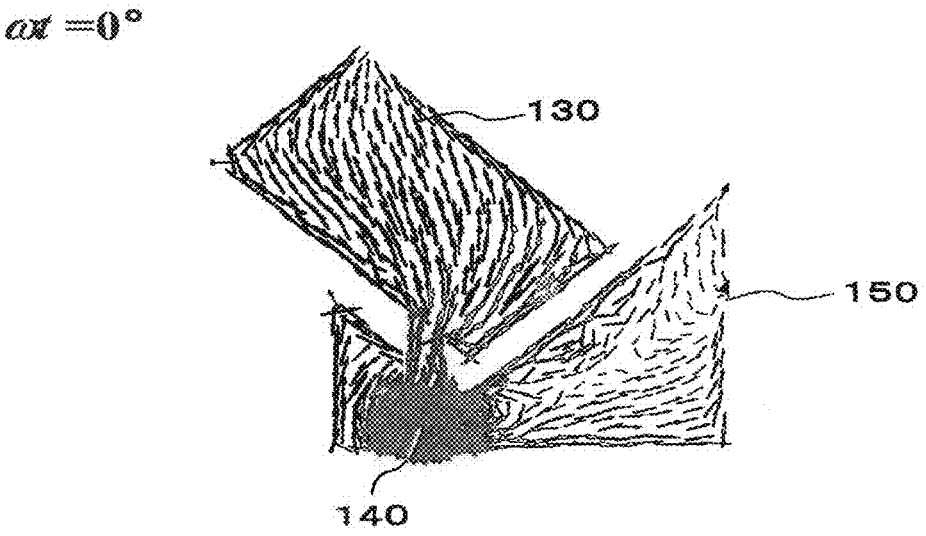
FIG. 14 is a diagram showing an electric current distribution state in the past planar antenna.

FIG. 14 shows an example of an electric current distribution state in the non-patent document 1. In this example, ωt is 0 degrees and the electric currents flow on the patch conductor 130 in a direction from a lower right to an upper left from the microstrip line 140 on a left side peripheral portion and a right side peripheral portion of the patch conductor 130. The electric currents passing through the patch conductor 130 contribute to the radiation. By paying attention to the left side peripheral portion and the right side peripheral portion, the electric currents cannot flow freely by restriction of a contour of the patch conductor 130. Therefore, wavelength of the electric currents near the contour does not vary continuously. In addition, a numeral, 150 indicates a ground conductor plate.

On the other hand, in FIG. 3B showing an example of the electric current distribution states of this invention, the electric currents flow on the patch conductor 30 in a direction from a lower left to an upper right from the microstrip line 40 on the left side peripheral portion and the right side peripheral portion of the patch conductor 30. Therefore, the electric currents passing through the patch conductor 30 contribute to the radiation. By paying attention to the left side peripheral portion and the right side peripheral portion, in the planar antenna 10 of the invention, the electric current exists, of which wavelength varies continuously from a case where the electric current passes through a center of the patch conductor 30 to a case where the electric current passes through along the contour, as being clear from FIGS. 3B and 3D, which is different from FIG. 12 of the non-patent document 1. Thus, since the electric current of continuous and broad wavelength flows, which leads to improvement of the frequency bandwidth. Therefore, the shape of the patch conductor 30 is not limited to the elliptical shape; it may be configured by a combination of any smooth curves such as a quadratic curve and a parabola.

Figure 8:
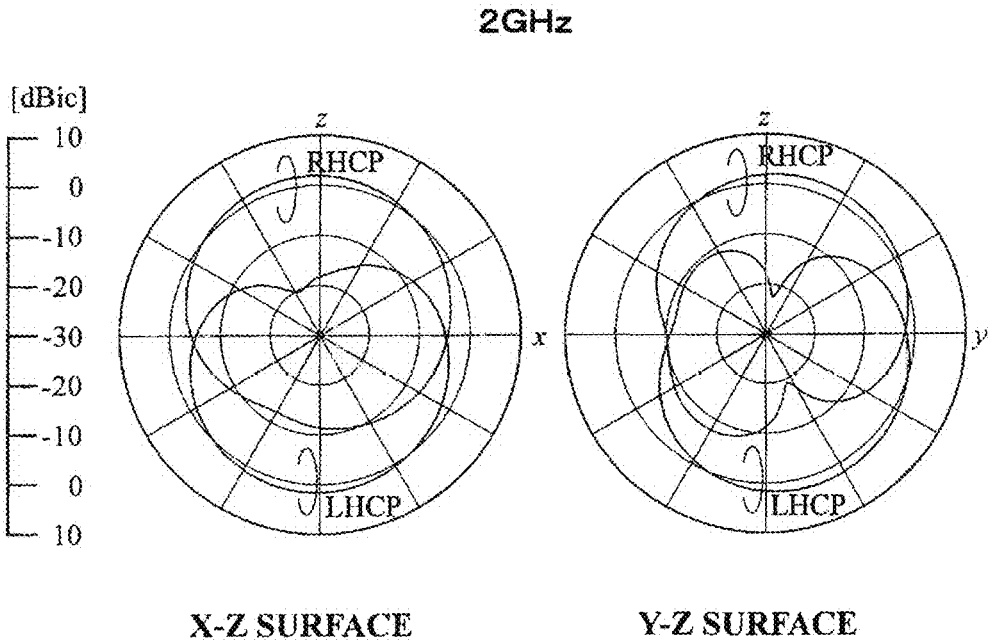
FIG. 8 is a characteristics graph showing radiation directivity in a band of 2 GHz.

FIGS. 8 through 11 show results of radiation directivity characteristics measured in every one GHz from 2 GHz to 5 GHz. FIG. 8 shows radiation directivity characteristic (dBi) of (x-z surface) and (y-z surface) in a band of 2 GHz. It can be seen that from the shown (x-z surface) and (y-z surface), right hand circularly polarized (RHCP) wave is evenly radiated in +z axis direction, and left hand circularly polarized (LHCP) wave is also evenly radiated in −z axis direction.

Figure 9:
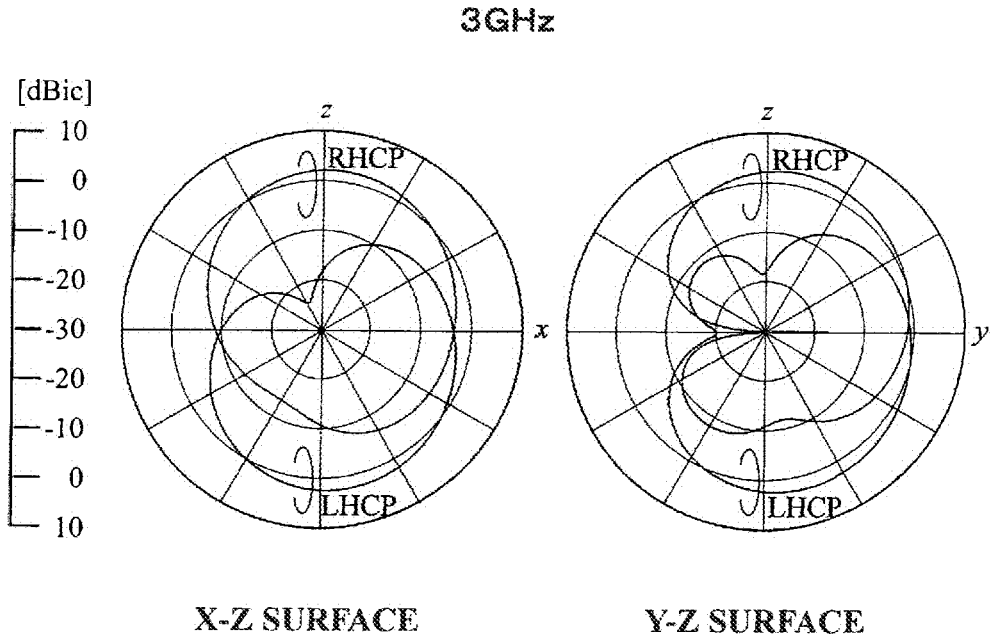
FIG. 9 is a characteristics graph showing the radiation directivity in a band of 3 GHz.

Similarly, FIG. 9 shows radiation directivity characteristic of (x-z surface) and (y-z surface) in a band of 3 GHz. Even in this case, it can be seen that the right hand circularly polarized (RHCP) wave is evenly radiated in +z axis direction, and the left hand circularly polarized (LHCP) wave is also evenly radiated in −z axis direction.

Figure 10:
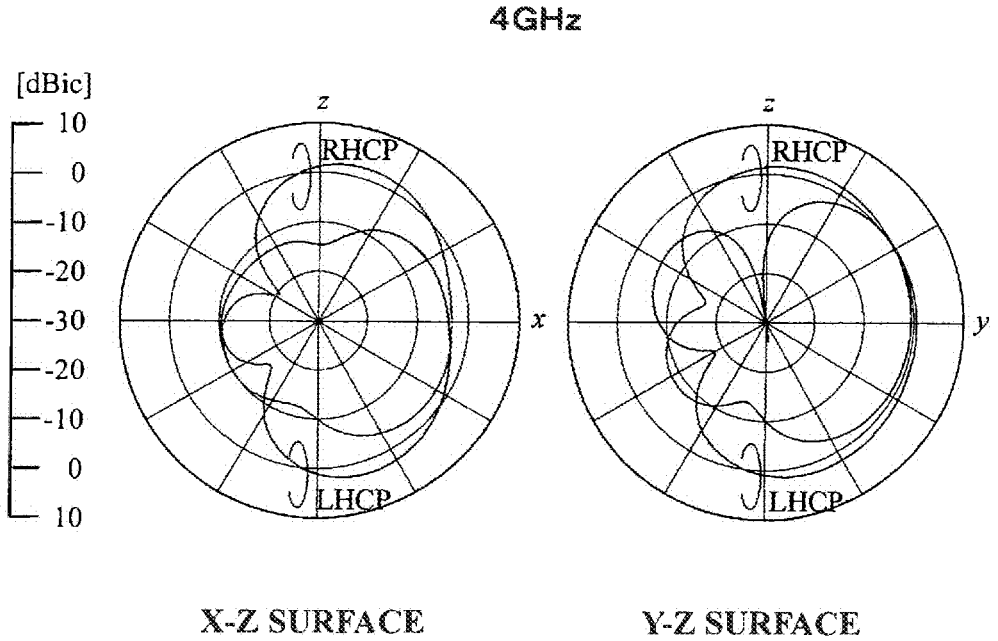
FIG. 10 is a characteristics graph showing the radiation directivity in a band of 4 GHz.

FIG. 10 shows radiation directivity characteristic of (x-z surface) and (y-z surface) in a band of 4 GHz. Even in the band of 4 GHz, it can be seen that the right hand circularly polarized (RHCP) wave is evenly radiated in +z axis direction, and the left hand circularly polarized (LHCP) wave is also evenly radiated in −z axis direction.

Figure 11:
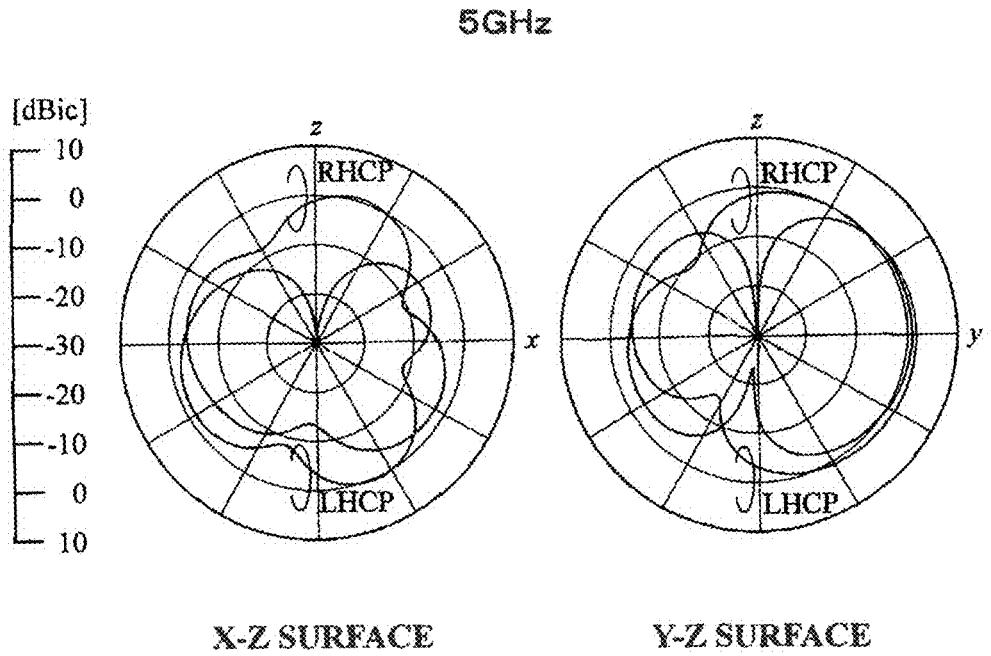
FIG. 11 is a characteristics graph showing the radiation directivity in a band of 5 GHz.

In addition, FIG. 11 shows radiation directivity characteristic of (x-z surface) and (y-z surface) in a band of 5 GHz. In the band of 5 GHz, the right hand circularly polarized (RHCP) wave is radiated in +z axis direction and the left hand circularly polarized (LHCP) wave is radiated in −z axis direction, but radiation directivity characteristic has some distortion compared with other frequency bands. The radiation directivity characteristic, however, is generally satisfactory as a whole.

A wideband antenna is generally required to have an even radiation directivity characteristic in the operational frequency bandwidth. In this invention, it can be confirmed that the almost even radiation directivity characteristic is obtained. Further, as shown in FIGS. 1 through 11, when it is used as the planar antenna particularly in WiFi band, a rectangular dielectric substrate 20 of 50 through 60 mm is used, and in that case, the gradient θ is preferable to be of 30 through 60 degrees and is very preferable to be of about 50 degrees particularly.

Figure 12:
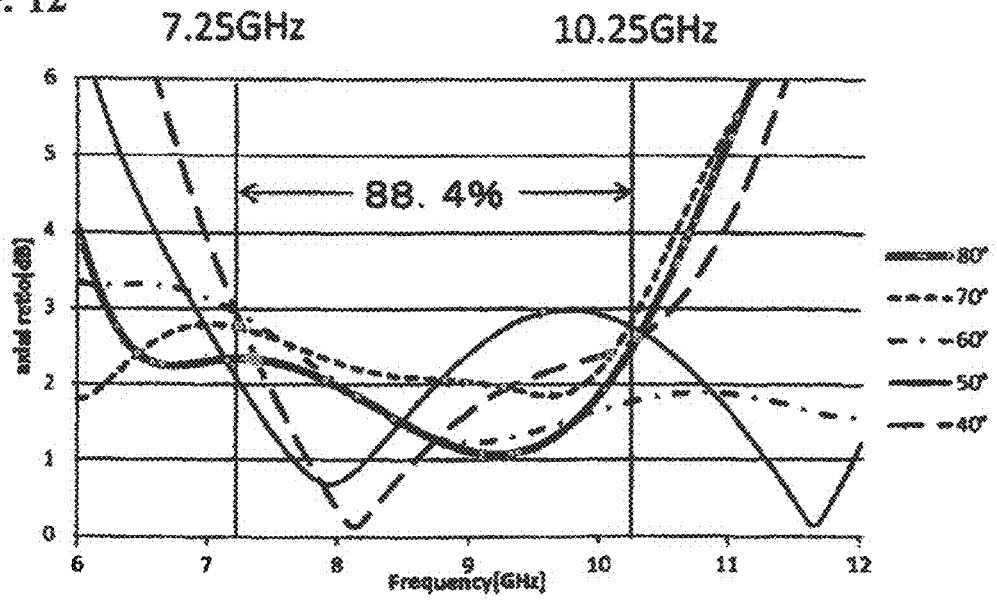
FIG. 12 is a characteristics graph showing antenna characteristics (axial ratio characteristics) when applying it to UWB band and changing a gradient θ of the patch conductor.

The embodiment shown in the figures up to FIG. 11 has indicated the antenna characteristics when it is used particularly in WiFi band (5.0 GHz band or less), but FIG. 12 and following will describe an embodiment applied to a higher frequency band. Specifically, it is UWB band that is used for a radar etc. The UWB band is a frequency band which is a general term for a frequency band from 3.1 GHz to 10.6 GHz but the following will describe the embodiment in which it is applied to, particularly, a band of 7 GHz or more (7.25 GHz through 10.25 GHz; UWB High band) in the UWB.

Antenna characteristics of the planar circularly polarized antenna 10 can be fixed by adjusting the gradient θ of the patch conductor 30 in relation to the orthogonal axis of the dielectric substrate 20. Here, the antenna characteristics mean the antenna characteristics satisfying that axial ratio (AR) is 3 dB or less and voltage standing wave ratio (VSWR) is 2 or less in the high frequency band of 7.0 GHz or more as described above (characteristic parameter $S_{11} \leq -10$ dB).

FIG. 12 shows values of axial ratio (AR) characteristics in the high frequency band of 6.0 GHz or more when changing the gradient θ from 40 degrees to 80 degrees. In the planar antenna 10 used in this case, a dielectric substrate 20 made of Teflon (registered trademark) and having a size of 19 through 20 mm square or less is used. Specifically, this dielectric substrate 20 is as follows.

Length W1 (=W2) is 19.34 mm;

Thickness is 1.6 mm;

Relative electric permittivity is 2.6; and

Dielectric loss tangent (tan 8) is 0.001.

Other specifications are suitably adjusted according to the gradient θ. In FIG. 12, the long dotted line indicates AR characteristic when θ=40 degrees; the fine solid line indicates AR characteristic when θ=50 degrees; the alternate long and short dashes line indicates AR characteristic when θ=60 degrees; the short dotted line indicates AR characteristic when θ=70 degrees; and the fat fine solid line indicates AR characteristic when θ=80 degrees.

In all of the gradients θ, the frequency band in which AR value becomes 3 dB or less is within a range of 7.25 GHz through 10.25 GHz. Among them, as the AR value, the gradient θ is preferably 50 or 60 degrees, more preferably their median (intermediate value from 50 degrees to 60 degrees; not shown). Thus, by adopting the above-mentioned gradients θ (40 degrees to 80 degrees), the wideband can be realized in the UWB High band.

Figure 13:
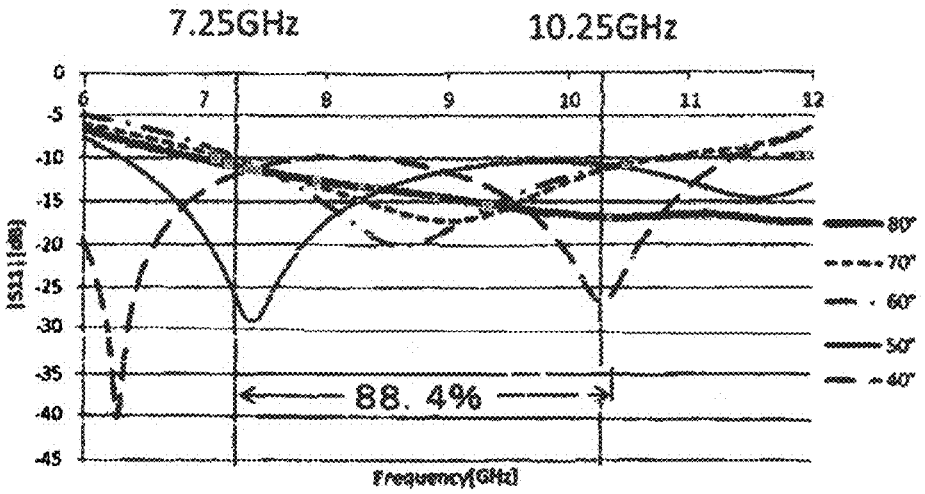
FIG. 13 is a characteristics graph showing antenna performance (standing wave ratio quality) when applying it to UWB band and changing the gradient θ of the patch conductor.

FIG. 13 shows VSWR characteristics in the high frequency band of 6.0 GHz or more when using the planar circularly polarized antenna 10, which is the same as the one used in FIG. 12. They are values thereof when changing the gradient θ from 40 degrees to 80 degrees like FIG. 12. In FIG. 13, the long dotted line indicates VSWR characteristic when θ=40 degrees. Hereinafter, the fine solid line indicates VSWR characteristic when θ=50 degrees and the alternate long and short dashes line indicates VSWR characteristic when θ=60 degrees. Further, the short dotted line indicates VSWR characteristic when θ=70 degrees, and the fat fine solid line indicates VSWR characteristic when θ=80 degrees. However, the vertical axis indicates a value of characteristics parameter $S_{11}$, which is different from it in the case shown in FIG. 4. As described above, $S_{11}$=−10 dB corresponds to VSWR=2 and it is preferably kept to the value thereof or less.

In the case of VSWR, the gradient θ of the patch conductor 30 is also preferably 50 or 60 degrees, more preferably their median (intermediate value from 50 degrees to 60 degrees; not shown).

Accordingly, the frequency bandwidth in which $S_{11}$ becomes −10 dB in all of the gradients θ is within a range of 7.25 GHz through 10.25 GHz High frequency bandwidth at UWB High band becomes 88.4% by adopting the above-described gradients θ (40 degrees to 80 degrees), which realizes the wideband. Therefore, the planar antenna in which the gradient θ of the patch conductor 30 is selected to be 40 degrees through 80 degrees is preferable as the antenna characteristics satisfying both of the AR characteristic and the VSWR characteristic. Thereby, it is applicable to any various kinds of radar antennas in which the wideband is desired in the UWB.

By the wideband planar circularly polarized antenna 10 according to the invention in which the elliptical typed planar monopole antenna is thus used, it is easy to manufacture the planar antenna because the antenna is an elliptical typed planar monopole antenna in which the printed board is used as the dielectric substrate 20. It is also possible to realize the thin and light-weight antenna so that the antenna is easy for an installation thereof and is also superior in portability. In addition, since the operational frequency bandwidth as the antenna characteristics can achieve 88.4%, the wideband antenna can be realized. And since an even gain is obtained in radiation directivity on the zenith direction, it can be used without considering the direction of the antenna.

By suitably selecting specifications (parameters) of the wideband planar circularly polarized antenna 10 such as selection of the shape, size of the dielectric substrate 20, and the gradient θ of the patch conductor 30, it is easily possible to set a target frequency band and bandwidth. Accordingly, the wideband planar circularly polarized antenna 10 according to the invention is applicable to a radar antenna, a collision prevention radar antenna for automobile, a vital observation antenna, an ETC antenna, an antenna for satellite and the like. It is applicable to an antenna device in which these wideband planar circularly polarized antennas using the monopole antenna according to the invention, and transmitting and receiving circuits or one of them, are installed.

In addition, although the embodiment in which the patch conductor 30 is inclined by θ to a right side in relation to the orthogonal axis of the dielectric substrate 20 has been described in FIG. 1, on the contrary, the patch conductor 30 may be inclined by θ to a left side in relation to the orthogonal axis of the dielectric substrate 20. In this case, the ground conductor plate 50 also becomes opposite so that it becomes a reversed shape of the one shown in FIG. 1.

In the wideband planar circularly polarized antenna 10 according to the invention, the right hand circularly polarized wave is radiated in the +z axis direction and the left hand circularly polarized wave is radiated in the −z axis direction shown in FIG. 1, but in order to radiate it only in one direction, by providing a reflector on the other side, a turning direction of the reflected wave becomes reverse so that the circularly polarized wave of a desired turning direction can be radiated in a desired direction.

INDUSTRIAL APPLICABILITY

Since it is not necessary to take a direction of the antenna into consideration in this invention, it is effectively applicable to a radar antenna, an antenna (wideband planar circularly polarized antenna) for collision prevention radar for automobile, for satellite, for a vital observation, for therapeutic use etc., and the antenna device installing the wideband planar circularly polarized antenna.

DESCRIPTION OF CODES

10: Wideband Planar Circularly Polarized Antenna
20: Dielectric Substrate
30: Patch Conductor
40: Microstrip Line
50: Ground conductor plate
60: Feeding Point
70: Coaxial Cable
θ: Gradient of Patch Conductor 30

The invention claimed is:

1. A wideband planar circularly polarized antenna comprising: a patch conductor formed on a front surface of a dielectric substrate, the patch conductor having a contour which is characterized by a smooth curve ora combination of smooth curves and an elliptical shape having a major axis; a microstrip line continuously connected to a bottom part of the patch conductor, the microstrip line having a linear center axis; and a ground conductor plate formed on a back surface of the dielectric substrate and aligned with the bottom part of the patch conductor; wherein the patch conductor is inclined so that its major axis has a predetermined gradient θ in relation to an orthogonal direction of the center axis of the microstrip line, the gradient θ of the patch conductor being within a range of 50° to 60°; and wherein the ground conductor plate has an approximately rectangular outer shape and has an upper periphery contour conforming to the contour of the bottom part of the patch conductor but being spaced apart from the contour of the bottom part of the patch conductor, thereby forming a gap as viewed in a plane parallel with the patch conductor, and wherein a diagonal line of the ground conductor plate is opposed to an inclination of the major axis of the patch conductor extending across the major axis of the patch conductor almost at a right angle.

2. The wideband planar circularly polarized antenna according to claim 1 characterized in that a total of lengths of the microstrip line and the major axis of the shape of the patch conductor is configured to be almost equal to a length of the diagonal line of the ground conductor plate.

3. An antenna device characterized in that the device includes the wideband planar circularly polarized antenna according to claim 1.

* * * * *